US005267399A

United States Patent [19]

Johnston

[11] Patent Number: 5,267,399

[45] Date of Patent: Dec. 7, 1993

[54] IMPLEMENT FOR SIMULTANEOUS SKIN CHILLING AND CHILLED GEL APPLICATION

[76] Inventor: William A. Johnston, 19145 D Ste. 132 Woodinville Duvall Rd., Woodinville, Wash. 98072

[21] Appl. No.: 984,846

[22] Filed: Dec. 3, 1992

Related U.S. Application Data

[60] Continuation-in-part of Ser. No. 825,518, Jan. 24, 1992, abandoned, which is a division of Ser. No. 757,019, Sep. 9, 1991, Pat. No. 5,152,064.

[51] Int. Cl.[5] ..... B26B 14/44

[52] U.S. Cl. ..... 30/41; 132/289; 222/146.6

[58] Field of Search ..... 30/41, 45, 34.05; 222/146.1, 146.6; 132/286, 289, 290, 313

[56] References Cited

U.S. PATENT DOCUMENTS 5,103,560 4/1992 Podolsky ..... 30/41

*Primary Examiner*—Douglas D. Watts

*Attorney, Agent, or Firm*—Robert W. Jenny

[57] ABSTRACT

The implement comprises a frame with two hollow rollers transversely mounted, one at each end of the frame. The frame encloses a container of shaving gel positioned to dispense gel onto the surface of one of the rollers. There is adjustment to provide for interruption of application of gel to the roller surface. The rollers are filled with a liquid or solutions having high latent heat of fusion.

2 Claims, 1 Drawing Sheet

IMPLEMENT FOR SIMULTANEOUS SKIN CHILLING AND CHILLED GEL APPLICATION

This application is a continuation-in-part of application Ser. No. 825,518, filed Jan. 24, 1992 now abandoned as a divisional application based on application Ser. No. 757,019, filed Sep. 9, 1991, now U.S. Pat. No. 5,152,064 all by the same inventor.

BACKGROUND OF THE INVENTION

1. Field

The subject invention is in the fields of skin conditioning methods and apparatus. Specifically, it is in the field of chilling skin for shaving purposes while simultaneously applying shaving gel. For purposes of this disclosure the term gel is to be recognized to mean foam, lather, cream or any other substance used to prepare skin to be shaven.

2. Prior art

There is much prior art in these fields. Skin conditioning, for purposes of this disclosure, includes methods and apparatus for applying shaving creams and the like and apparatus for chilling the skin to be shaved. The U.S. patents listed below provide a sample of the patented prior art.

| | |
|---|---|
| 1,270,635* | 3,339,278 |
| 1,882,370* | 3,756,105 |
| 2,472,385* | 3,768,485 |
| 2,749,613 | 4,813,136 |
| 2,787,621* | 4,819,330 |
| 2,929,374 | 4,845,846 |
| | 5,103,560 |

The asterisked patents illustrate a variety of hollow, cylindrical rollers, each mounted on a handle or handles and filled or fillable with liquids, solutions or gels, all for the purpose of providing cooled or heated rollers to be applied to skin areas for a variety of purposes, including (1) massaging and (2) astringing an area of skin. None of these apparatuses are used to apply any substance or the like to the skin. The liquids, solutions and gels are used in the rollers to increase the cooling capacity, (i.e. heat removing capability) relative to the volume of the roller.

U. S. Pat. No. 5,103,560 describes apparatus which can be described as a handle for a safety razor, the handle incorporating cavities and mechanisms which enable dispensing shaving lotion and water, in individually controlled amounts, onto the skin to be shaved by the razor. The apparatus includes a plurality of balls which rotate in sockets when contacting the skin and carry water on their surfaces for disposition of the water on the skin. There are no provisions made in this apparatus which increase its heat capacity for purposes of warming or chilling skin. On the other hand, if the apparatus is chilled to below freezing, it is rendered inoperative.

It has been found in the development of the subject invention that the amount of gel applied to the skin while shaving is highly important to achieving high quality shaving results. It has also been found that adequate chilling of the skin is essential to achieving optimum results and that the manner in which the gel is applied is important to achieving optimum results. It is a great advantage if the gel is thoroughly chilled prior to application so that its application complements the chilling provided by the skin contacting components of the implement. Accordingly, it is important that the amount of gel applied and the amount of chilling be independent of each other to a considerable degree.

In spite of the profusion and diversity of the prior art, there are many people who are not able to shave comfortably and to their satisfaction in terms of appearance, freedom from bristly texture (i.e. smoothness) and the duration of satisfactory appearance and smoothness if achieved. Such people often have a combination of soft, tender skin and strong or strong and curly hair growing from the tender skin. Accordingly, the primary objective of the subject invention is to provide skin chilling apparatus which helps provide comfortable, smooth, long lasting shaving results, particularly for people who have tender skin and tough or tough and curly hair and those who desire particularly smooth feeling skin after shaving for cosmetic purposes. Further objectives are that (1) the apparatus have sufficient heat capacity to allow a complete shave without requiring rechilling of the chilling apparatus, (2) the apparatus dispenses shaving gel onto the skin to be shaved and (3) the amount of chilling and the amount of gel dispensed be independent of each other. Another objective is that the time required for chilling be minimized.

SUMMARY OF THE INVENTION

The subject invention is apparatus for chilling skin to be shaved before, during and after applying shaving gel to the skin. The chilling is done by applying a cold implement such as a roller to the skin and applying a thin layer of chilled shaving gel with the implement.

The implement comprises at least one roller pivoted in a handle. A container of shaving gel is also carried in the handle. The container is manually extendable to cause dispensing of shaving gel onto the surface of the roller or retractable to prevent dispensing gel until more is needed. There may be a second roller also mounted on the handle with shaving gel not dispensed onto it.

Before use the chilling implement, complete with the shaving cream supply, is refrigerated to the temperature in the freezing compartment of residential refrigerators, i.e. about 0 degrees F. It is then usable in a shaving method which comprises the steps of:

a) Refrigerating the chilling implement and shaving cream supply;

b) Using the chilling implement to chill a portion of the area to be shaved while applying shaving gel;

c) Shaving the portion of skin by rolling it ahead of a plurality of parallel linearly and rockably deflectable cutting edges while oscillating the cutting edges in the direction of cutting; and d) Repeating steps a through c until all the areas to be shaved are shaved.

The invention is described in more detail below with reference to the attached drawings.

DETAILED DESCRIPTION OF THE INVENTION

Figure 1:
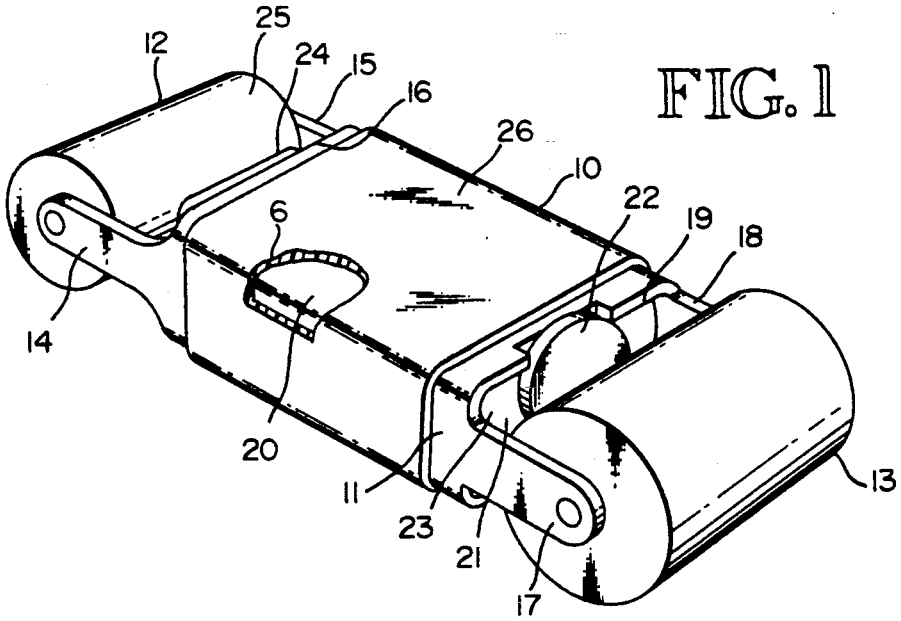
FIG. 1 is a perspective view of the subject implement.

The subject invention is an implement for simultaneously chilling skin and applying chilled shaving gel to skin to be shaved. The implement 10 is shown in perspective in FIG. 1 and comprises a frame 11 and rollers 12 and 13. Roller 12 is rotatably mounted in arms 14 and 15 at end 16 of the frame and roller 13 is rotatably mounted in arms 17 and 18 at end 19 of the frame. Center portion 20 of the frame is configured to hold container 21 of shaving gel. The container is installed or removed for replacement for removing roller 13. Knob 22 on end 23 of the container is operable to cause gel 24 to be extended to be dispensed onto surface 25 of roller 12 or to be retracted so that roller 12 can be used without adding more gel to its surface. In this embodiment of the invention the axes of rotation of the rollers are parallel to each other and perpendicular to the longitudinal axis of the frame.

The rollers are hollow, made of material having high thermal conductivity and filled with liquid or solution having high latent heat of fusion. The frame may be made of material having high thermal conductivity. If so it may be fitted with an insulating covering 26 for reasons explained below. Alternately, the frame may be made of material having low thermal conductivity.

In use the subject implement, including the gel in its container, is chilled to a temperature in the range of −10° to +10° F. with 0° F. preferred. The roller to which the gel is applied is then applied to and rolled over skin to be shaved, simultaneously chilling the skin and applying gel. When sufficient gel is supplied, supplemental chilling, as needed without adding gel is done by either using the other roller or by retracting the gel supply from the gel application roller. Retracting the gel supply to limit gel application enables making the implement with only the gel application roller. However, it has been found that using two rollers alternately is more convenient, provides adequate cooling capacity in a more compact implement and saves time as explained below.

Providing insulating pads on the frame or making it of low thermal conductivity material makes handling the chilled implement more comfortable to the user's fingers. Further, surfaces of the insulation pads or the frame surface may be textured to facilitate holding the chilled implement.

It has also been found during the development of the subject implement that to have sufficient chilling capacity for shaving a face, assuming the roller(s) have optimum latent heat of fusion characteristics, the volume of the roller(s) must be in the range of 3 to 6 cubic inches, with 4.5 cubic inches embodied in 2 rollers preferred.

It is notable that the surface of a roller warms up fairly quickly during use but cools off when the roller surface is removed from the skin and the heat is absorbed in supplying the latent heat of fusion to the frozen liquid or solution enclosed in the roller. This phenomenon is the basis of a further advantage of using two rollers; i.e. one roller is used while the surface of a previously used roller is recooling, thus saving time needed to adequately chill the skin.

It is considered to be understandable from this description that the subject invention meets its objectives. It provides a skin chilling implement having sufficient capacity to allow a complete shave without rechilling the implement. The implement dispenses shaving gel while chilling and the amounts of chilling and gel dispensed are independent of each other. Also, the time required for chilling is minimized by the use of two chilling components, used alternately.

It is also considered to be understood that while certain embodiments of the invention are described herein, other embodiments and modifications of those enclosed are possible within the scope of the invention which is limited only by the attached claims.

I claim:

1. An implement for chilling skin and simultaneously applying shaving gel to said skin, said gel being contained in a container having means for adjusting the dispensing of said gel, said implement comprising:

a frame having first and second ends and a longitudinal axis, and first and second hollow rollers made of thermally conductive material, each having an axis of rotation and a volume, said first roller being rotatably mounted at said first end of said frame with said axis of rotation of said first roller perpendicular to said longitudinal axis, and second roller being rotatably mounted at said second end of said frame with said axis of rotation of said second roller perpendicular to said longitudinal axis, said frame being configured such that said container can be installed in said frame such that said gel can be dispensed on one of said rollers and said means for adjusting is accessible for adjusting dispensing said gel onto said one of said rollers.

2. The implement of claim 1 in which the sum of said volume of said first roller and said volume of said second roller is in the range of 3 to 6 cubic inches.

* * * * *